US010711970B2

(12) United States Patent
Noh et al.

(10) Patent No.: US 10,711,970 B2
(45) Date of Patent: Jul. 14, 2020

(54) LAMP AND VEHICLE HAVING SAME

(71) Applicant: LG INNOTEK CO., LTD., Seoul (KR)

(72) Inventors: Jae Myeong Noh, Seoul (KR); Dong Il Eom, Seoul (KR); Nam Seok Oh, Seoul (KR); Young Jun Cho, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 143 days.

(21) Appl. No.: 16/077,786

(22) PCT Filed: Dec. 21, 2016

(86) PCT No.: PCT/KR2016/015014
§ 371 (c)(1),
(2) Date: Aug. 14, 2018

(87) PCT Pub. No.: WO2017/142181
PCT Pub. Date: Aug. 24, 2017

(65) Prior Publication Data

US 2020/0158309 A1 May 21, 2020

(30) Foreign Application Priority Data

Feb. 15, 2016 (KR) ..... 10-2016-0017424

(51) Int. Cl.
*F21S 43/247* (2018.01)
*F21S 43/241* (2018.01)
*F21S 43/14* (2018.01)

(52) U.S. Cl.
CPC ..... *F21S 43/247* (2018.01); *F21S 43/14* (2018.01); *F21S 43/241* (2018.01)

(58) Field of Classification Search
CPC ..... F21S 43/247; F21S 43/214; F21S 43/14; F21S 43/00; F21S 43/50; F21S 43/40; F21S 43/26; F21S 43/245; F21S 43/243; F21S 43/241; F21S 43/195; B60Q 1/00; F21W 2107/00
See application file for complete search history.

(56) References Cited

U.S. PATENT DOCUMENTS

2003/0193815 A1 10/2003 Mishimagi
2013/0128601 A1 5/2013 Kim et al.
(Continued)

FOREIGN PATENT DOCUMENTS

EP 2071228 A2 6/2009
EP 2407709 A2 1/2012
EP 3096072 A1 11/2016
(Continued)

*Primary Examiner* — Joseph L Williams
*Assistant Examiner* — Jose M Diaz
(74) *Attorney, Agent, or Firm* — Birch, Stewart, Kolasch & Birch, LLP

(57) ABSTRACT

The present invention relates to a lamp and a vehicle having the same, the lamp comprising: a housing; a substrate arranged on the housing; a first light source and a second light source arranged on one side surface and the other side surface of the substrate, respectively; and a light guide arranged on a path of light emitted from the second light source. Accordingly, the lamp can both realize stereoscopic lighting and improve the design-related degree of freedom when installed on a vehicle.

17 Claims, 8 Drawing Sheets

(56) References Cited

U.S. PATENT DOCUMENTS

| | | | | |
|---|---|---|---|---|
| 2015/0346422 | A1 | 12/2015 | Jang et al. | |
| 2019/0097092 | A1* | 3/2019 | Yamae | H01L 33/50 |

FOREIGN PATENT DOCUMENTS

| | | | |
|---|---|---|---|
| JP | 2011-34729 | A | 2/2011 |
| JP | 2014-207247 | A | 10/2014 |
| KR | 10-1342059 | B1 | 12/2013 |
| KR | 10-1405385 | B1 | 6/2014 |
| WO | WO 2015/186931 | A1 | 12/2015 |

* cited by examiner

【Figure 1】
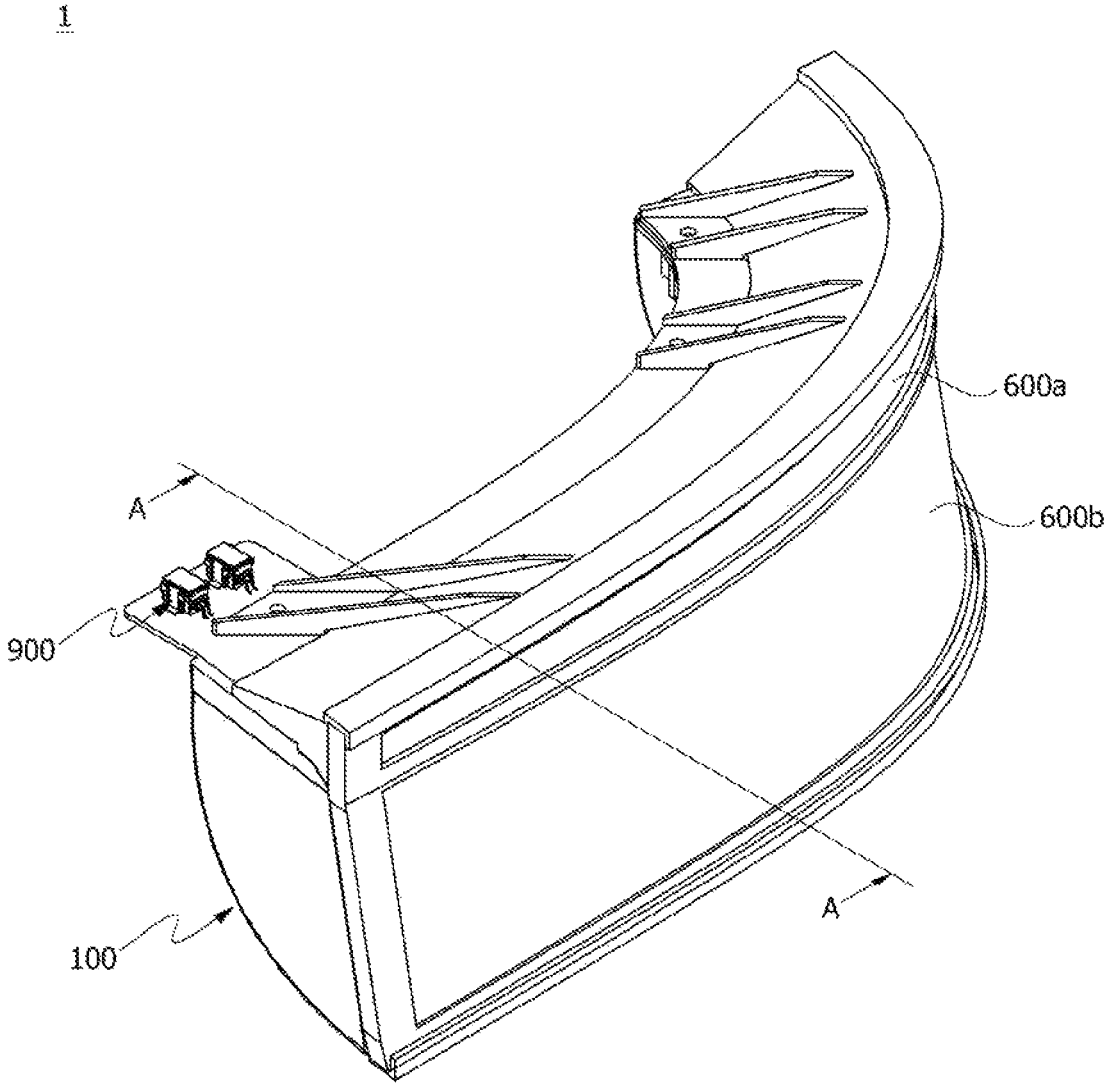

【Figure 2】
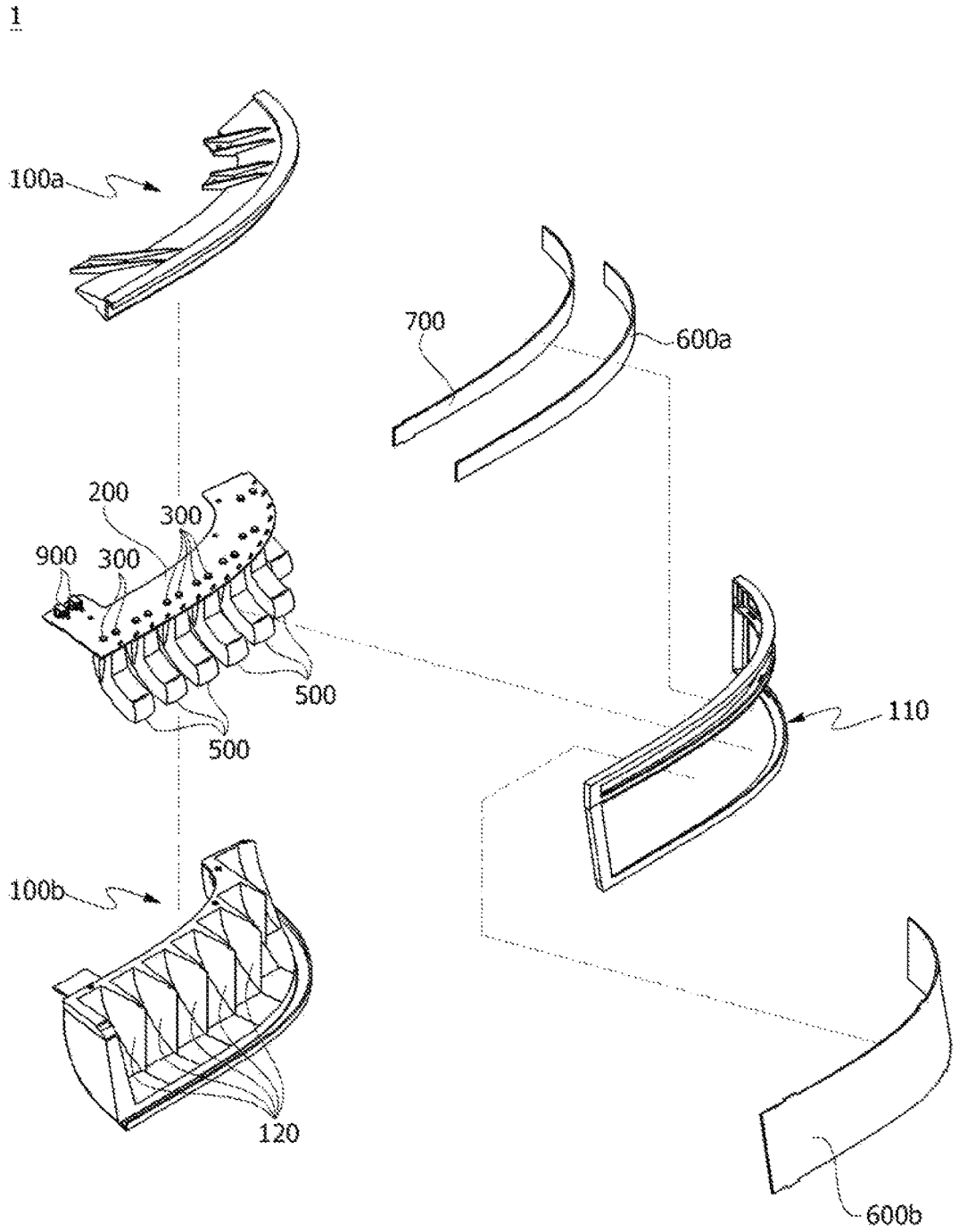

【Figure 3】
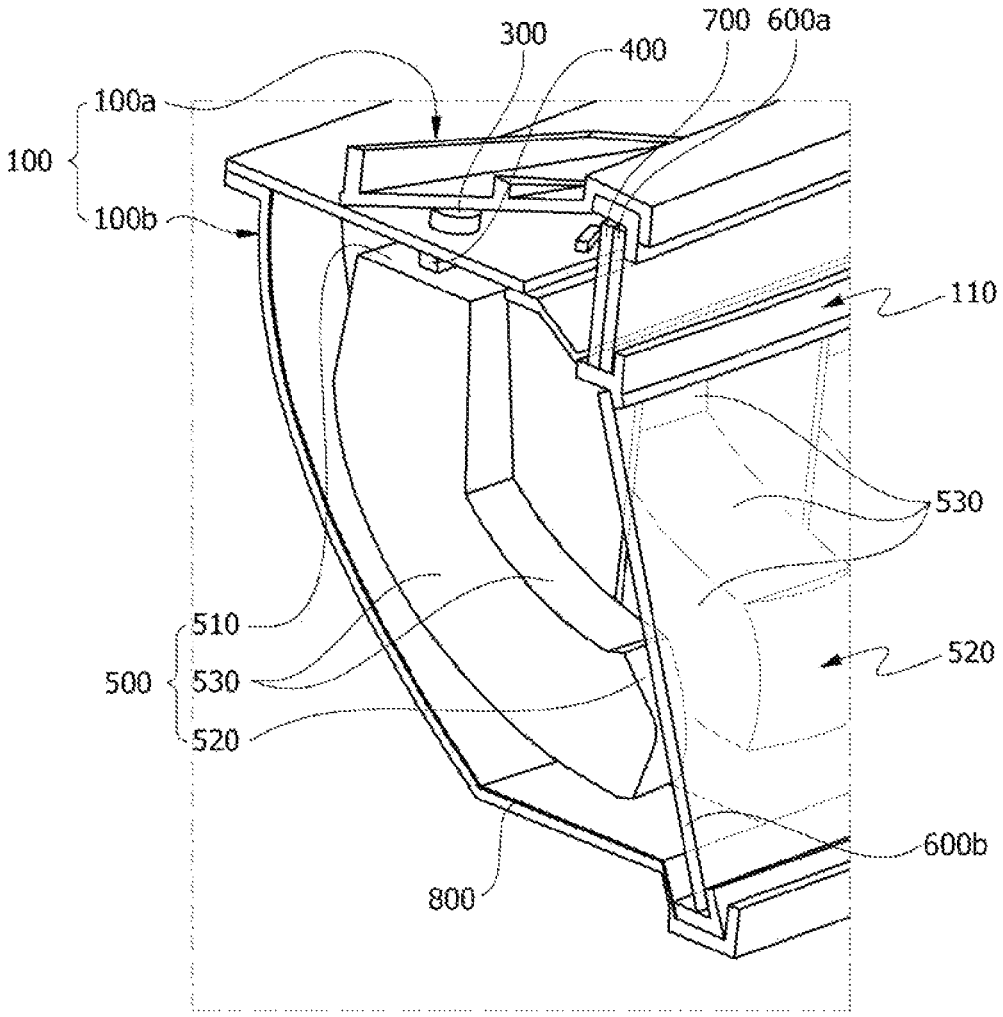

【Figure 4】
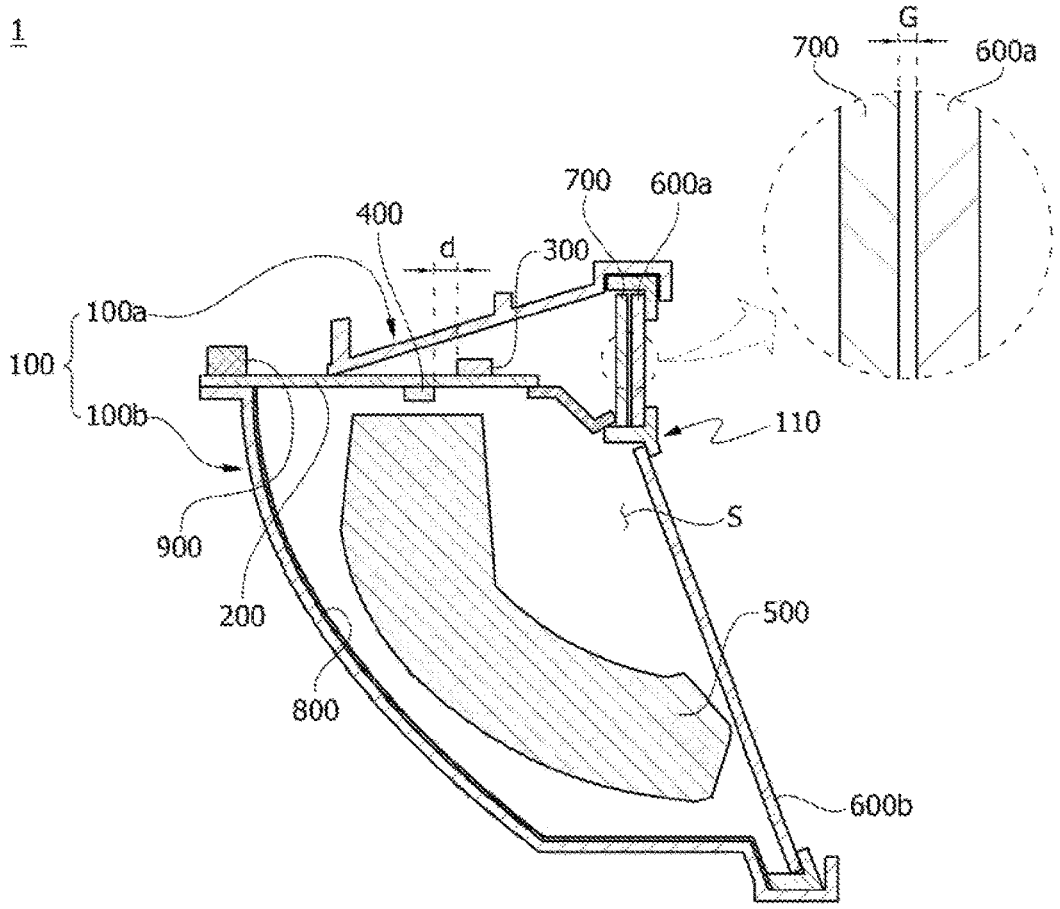

【Figure 5】
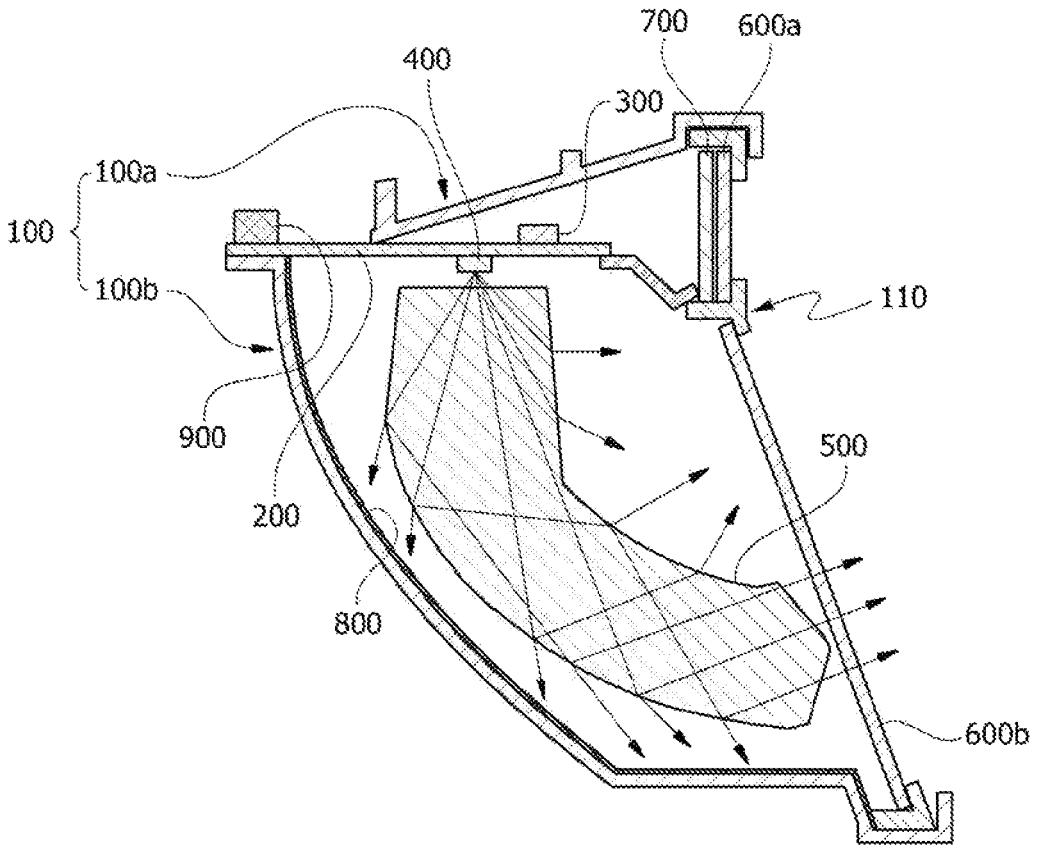

【Figure 6】
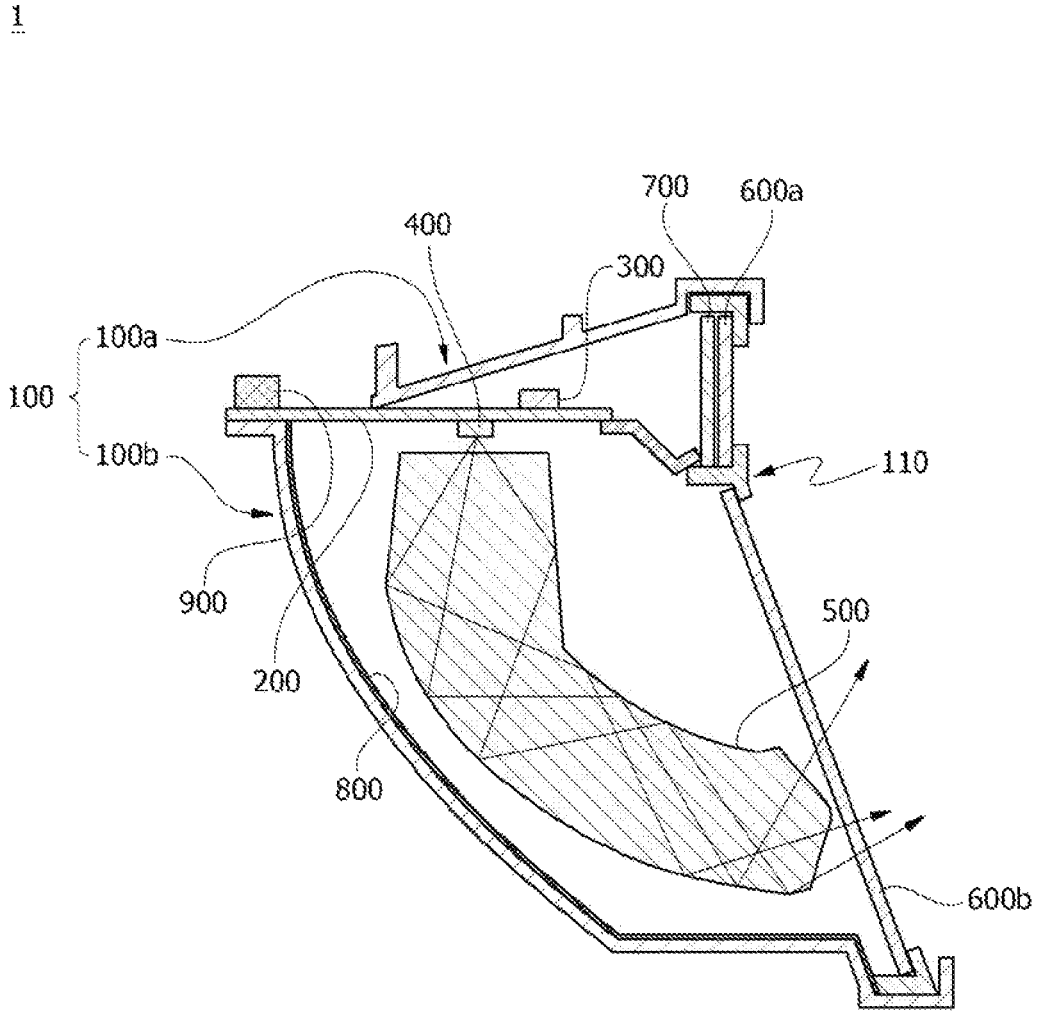

【Figure 7】
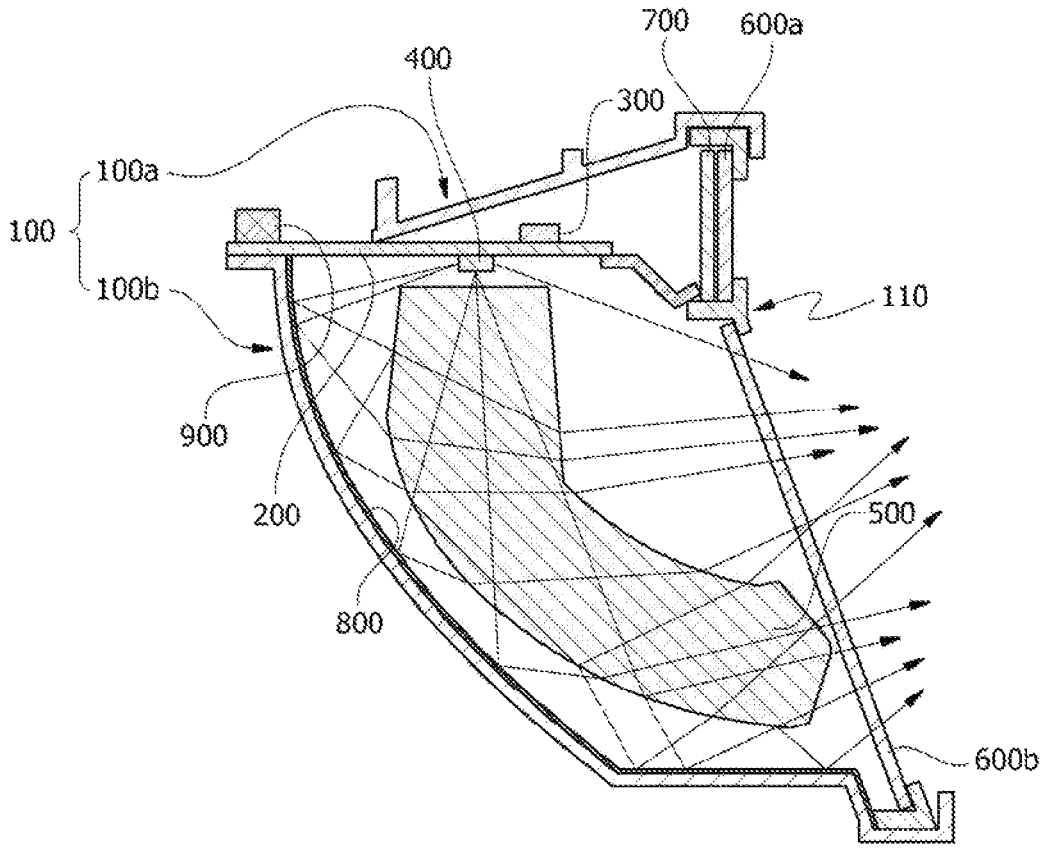

【Figure 8】
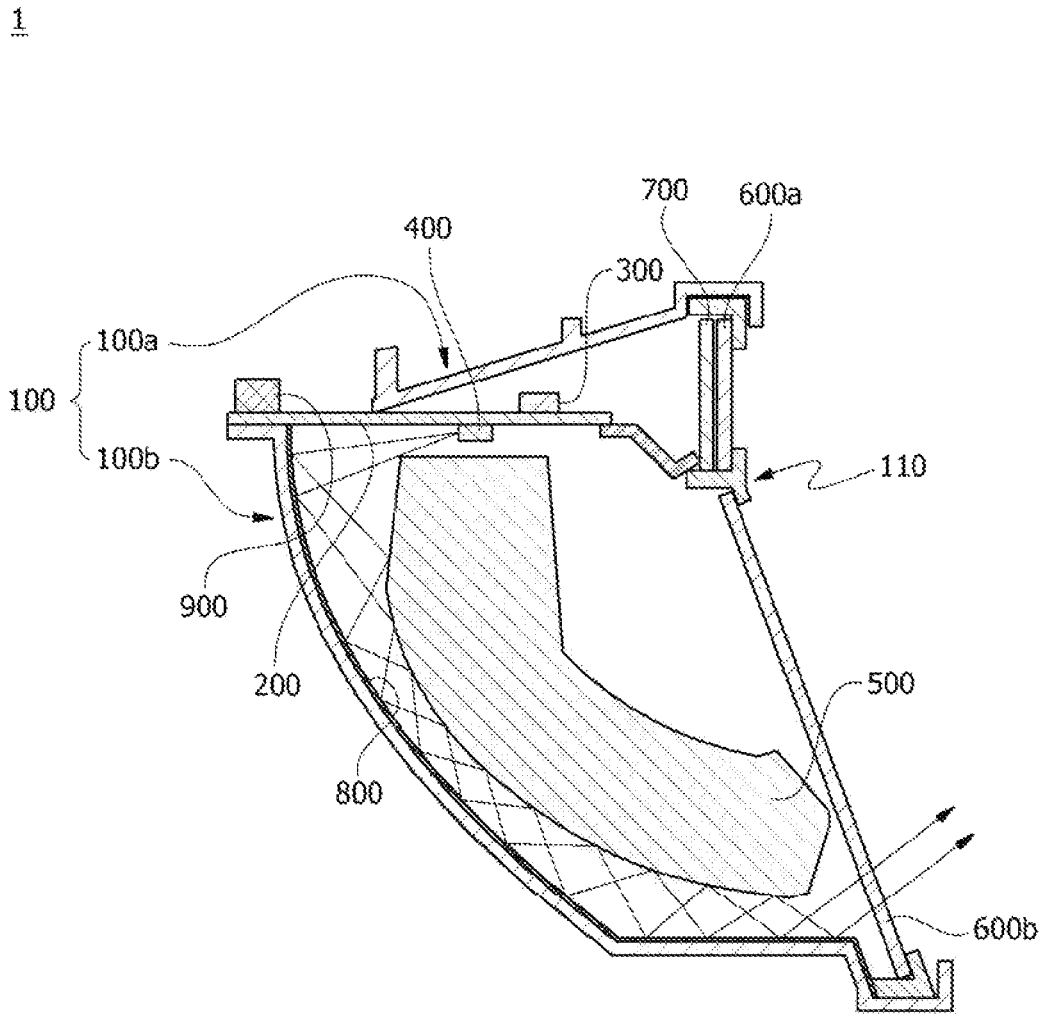

LAMP AND VEHICLE HAVING SAME

CROSS REFERENCE TO RELATED APPLICATIONS

This application is the National Phase of PCT International Application No. PCT/KR2016/015014, filed on Dec. 21, 2016, which claims priority under 35 U.S.C. 119(a) to Patent Application No. 10-2016-0017424, filed in the Republic of Korea on Feb. 15, 2016, all of which are hereby expressly incorporated by reference into the present application.

TECHNICAL FIELD

The present invention relates to a lamp and a vehicle having the same.

BACKGROUND ART

Generally, since a light emitting diode (LED) has an advantage as a light source in terms of output, efficiency, and reliability, the LED has been actively researched and developed as a high-output and highly efficient light source for various lights and lamps as well as a backlight of a display device.

Recently, the LED has variously been applicable to a headlamp, a fog lamp, a backup lamp, a clearance lamp, a license plate lamp, a rear tail lamp, a brake lamp, a turn signal lamp, and a hazard flasher, which are installed outside the vehicle, or a room lamp installed inside a vehicle, or the like.

Among the lamps described above, combination lamps are detachably or attachably mounted on a front side and a rear side of the vehicle so as to allow an occupant to inform of his/her driving intentions at night to drivers of a car ahead and a car behind, and thus safe driving can be performed. That is, the occupant's vehicle is visible to the drivers of other vehicles, and thus defensive driving can be performed.

Particularly, the rear combination lamps mounted on the left and right of the rear sides of the vehicle include a backup lamp, a rear tail lamp, a brake lamp, and a turn signal lamp integrated therein.

However, most lights of the rear combination lamp are generally used as a surface light source in terms of luminance using a member for efficient light transmission such as a light guide panel or the like.

Therefore, a conventional rear combination lamp has a problem in providing three-dimensional lighting.

DISCLOSURE

Technical Problem

The present invention is directed to providing a vehicle lamp which uses at least two different light sources emitting lights in different directions and includes a light guide disposed in at least one of the light sources so as to provide three-dimensional lighting, and a vehicle having the same.

Objectives of the present invention are not limited to the above-mentioned objects, and other unmentioned objectives may be obviously understood by those skilled in the art from the following description.

Technical Solution

One aspect of the present invention provides a lamp which includes a housing, a substrate disposed in the housing, a first light source and a second light source disposed on one surface of the substrate and the other surface of the substrate, respectively, and a light guide disposed on an emission line of light of the second light source.

The substrate may be disposed to divide the housing into a first housing part and a second housing part.

The first light source and the second light source may be installed on the substrate to be spaced apart from each other by a predetermined distance d.

The lamp may further include a first lens disposed on an emission line of light of the first light source and a diffuser disposed between the first light source and the first lens.

The diffuser may be disposed to be spaced apart from the first lens.

The light guide may have one end disposed to be spaced apart from the second light source.

The lamp may further include a second lens disposed on the emission line of light of the second light source.

The light guide may be disposed to be spaced apart from an inner surface of the second housing part.

The second housing may include a reflective part disposed on an inner surface thereof.

One end of the light guide may be bent, and the other end of the light guide may be disposed to face the second lens.

The light guide may be formed in a polygonal pillar shape.

The light guide may include an incidence surface to which the light of the second light source is incident, an exit surface, and a plurality of side surfaces disposed between the incidence surface and the exit surface.

A part or an entirety of the side surfaces may be formed as a half mirror.

The exit surface may be formed to protrude toward the second lens.

The part or the entirety of the side surfaces may be formed as a mirror.

The plurality of light guides disposed to be spaced apart from the plurality of second light sources may be disposed to be spaced apart from each other.

The first and second light sources may be formed as a light emitting diode (LED).

Another aspect of the present invention provides a vehicle which includes the above-described lamp used as a tail lamp and a stop lamp.

Advantageous Effects

A lamp according to an embodiment of the present invention can provide three-dimensional lighting using at least two different light sources emitting light in different directions.

At least one of the light sources includes a light guide disposed therein, and thus the three-dimensional lighting can be improved.

Further, the light guide is formed in a polygonal shape using a half mirror, and thus the three-dimensional lighting can be more improved, and a design degree of freedom can be increased.

Therefore, the lamp according to the embodiment of the present invention can simultaneously provide three-dimensional lighting using at least two different light sources emitting light in different directions, and the light guide, and can increase the design degree of freedom for the vehicle lamp.

DESCRIPTION OF DRAWINGS

FIG. 1 is a perspective view showing a lamp according to one embodiment of the present invention.

FIG. 2 is an exploded perspective view showing the lamp according to one embodiment of the present invention.

FIG. 3 is a cross-sectional perspective view taken along line A-A of FIG. 1.

FIG. 4 is a cross-sectional view taken along line A-A of FIG. 1.

FIG. 5 is a view showing light emission of a light guide formed as a half mirror in the lamp according to one embodiment of the present invention.

FIG. 6 is a view showing light emission of a light guide formed as a mirror in the lamp according to one embodiment of the present invention.

FIG. 7 is a view showing light reflection of a reflective part and a light guide formed as a half mirror in the lamp according to one embodiment of the present invention.

FIG. 8 is a view showing light reflection of a reflective part and a light guide formed as a mirror in the lamp according to one embodiment of the present invention.

MODES OF THE INVENTION

While the present invention is susceptible to various modifications and alternative forms, specific embodiments thereof are shown by way of example in the drawings and will herein be described in detail. It should be understood, however, that there is no intent to limit the present invention to the particular forms disclosed, but on the contrary, the present invention is to cover all modifications, equivalents, and alternatives falling within the spirit and scope of the present invention.

It will be understood that, although the terms "first," "second," etc. may be used herein to describe various elements, these elements should not be limited by these terms. These terms are only used to distinguish one element from another. For example, a first element could be termed a second element, and similarly, a second element could be also termed a first element, without departing from the scope of the present invention. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

In the following description of the embodiments, it will be understood that, when each element is referred to as being "on" or "under" another element, it can be "directly" on or under another element or can be "indirectly" formed such that an intervening element is also present. In addition, it will also be understood that "on" or "under" one element may mean an upward direction and a downward direction of the element.

The terminology used herein is for the purpose of describing particular embodiments only and is not intended to be limiting of the present invention. The singular forms are intended to include the plural forms as well, unless the context clearly indicates otherwise. In the present invention, it will be further understood that the terms "comprise," "comprising," "include," and/or "including" when used in this specification, specify the presence of stated features, integers, steps, operations, elements, components and/or groups thereof, but do not preclude the presence or addition of one or more other features, integers, steps, operations, elements, components and/or groups thereof.

Unless otherwise defined, all terms including technical and scientific terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, embodiments of the present invention will be described in detail with reference to the accompanying drawings. The same reference numerals will be used to describe the same or like components, and a redundant description thereof will be omitted.

Referring to FIG. 1, a lamp 1 according to an embodiment of the present invention may be used as a vehicle lamp installed in a vehicle.

Particularly, the lamp 1 may be used as a tail lamp and a stop lamp of a rear combination lamp for a vehicle.

Referring to FIGS. 1 to 4, the lamp 1 according to the embodiment of the present invention may include a housing 100, a substrate 200, a first light source 300, a second light source 400, a light guide 500, lenses 600*a* and 600*b*, a diffuser 700 diffusing light, a reflective part 800, and a converter 900.

Hereinafter, in the description of the lamp 1 according to the embodiment of the present invention, for clarity of description, a lens mounted on the first light source 300 refers to a first lens 600*a*, and a lens mounted on the second light source 400 refers to a second lens 600*b*.

Therefore, the lenses 600*a* and 600*b* may be divided into the first lens 600*a* and the second lens 600*b* according to a position of a light emission line of each of the first light source 300 and the second light source 400.

Further, as shown in FIG. 2, a plurality of the first light source 300 and the second light source 400 may be disposed on the substrate 200, and the number of the light guides 500 may be installed to be the same as that of the second light sources 400.

The housing 100 may include an opening and an accommodation space S formed on one side thereof.

As shown in FIGS. 3 and 4, the lenses 600*a* and 600*b* and the diffuser 700 may be disposed on the opening side of the housing 100.

The lenses 600*a* and 600*b* and the diffuser 700 improve uniformity of the exiting light and soften the light.

Further, the substrate 200, the first light source 300, the second light source 400, and the light guide 500 may be disposed in the accommodation space S of the housing 100.

Further, the housing 100 further includes a cover 110 partially covering the opening.

Referring to FIG. 2, the cover 110 supports the lenses 600*a* and 600*b* and the diffuser 700 to be fixed to the opening side of the housing 100.

As shown in FIGS. 3 and 4, the substrate 200 may be disposed in the housing 100 to divide the housing 100 into a first housing part 100*a* and a second housing part 100*b*.

The first housing part 100*a* allows the light emitted from the first light source 300 toward the first lens 600*a* to be diffused. Further, the second housing part 100*b* may allow the light emitted from the second light source 400 toward the second lens 600*b* to be diffused. In this case, referring to FIGS. 3 to 8, one inner surface of the second housing part 100*b* may be formed at a predetermined curvature.

Further, the second housing part 100*b* may include a plurality of blocking parts 120 providing uniform three-dimensional lighting by blocking a light interference between the plurality of second light sources 400.

Therefore, since separate lights are emitted by the two light sources 300 and 400 in the housing 100 divided by the substrate 200, the lamp 1 may provide three-dimensional lighting using the lights emitted by being divided by the first housing part 100*a* and the second housing part 100*b*.

Meanwhile, the substrate 200 may use a flat printed circuit board (PCB) on which a circuit pattern is formed, but the present invention is not limited thereto. The substrate 200 may use a flexible printed circuit board (FPCB) so as to secure predetermined flexibility according to a shape of the housing 100.

Referring to FIGS. 2 to 4, the first light source 300 and the second light source 400 may be disposed on one surface and the other surface of the substrate 200, respectively. That is, the first light source 300 and the second light source 400 may be disposed on an upper surface and a lower surface of the substrate 200, respectively. The first light source 300 and the second light source 400 may be electrically connected to the substrate 200.

In this case, as shown in FIG. 4, the first light source 300 and the second light source 400 may be disposed to be spaced apart from each other along a horizontal direction of the substrate 200. That is, the first light source 300 and the second light source 400 are installed to be spaced apart from each other by a predetermined distance d so as to prevent heat from being concentrated on one area of the substrate 200.

In this case, a light emitting diode (LED) may be used as the first light source 300 and the second light source 400, but this is only an example of the present invention, and various light sources, such as a bulb, may be used.

Referring to FIGS. 2 to 4, the plurality of light guides 500 guiding the light emitted from the second light source 400 may be disposed in the second housing part 100*b* and may be disposed to be spaced apart from each other.

Further, the light guide 500 may be formed in a shape in which one area thereof is bent, and may be formed in a polygonal shape including an incidence surface 510, to which a light of the second light source 400 is incident, an exit surface 520, and a plurality of side surfaces 530.

As shown in FIGS. 2 and 3, the light guide 500 may be formed in a square pillar shape having one bent area, but the present invention is not limited thereto, and the light guide 500 may be formed in various polygonal shapes, such as a hexagonal pillar and an octagonal pillar having one bent area, and the like, so as to provide three-dimensional lighting.

That is, the plurality of side surfaces 530 may form the light guide 500 having a polygonal pillar shape with a plurality of surfaces.

In this case, as shown in FIG. 5, the side surfaces 530 may be provided as a half mirror that reflects a part of light and transmits a part of the light to the outside. A part or an entirety of the plurality of side surfaces 530 may be formed as the half mirror.

Further, the part or the entirety of the plurality of the side surfaces 530, as shown in FIG. 6, may be formed as a mirror that reflects a light emitted from the second light source 400.

Therefore, when the side surfaces 530 are made as the half mirror, more subdued three-dimensional lighting can be provided than when the light is diffused only through the exit surface 520.

Further, when the side surfaces 530 are formed as the mirror, three-dimensional lighting in which the light incident through the incidence surface 510 is diffused only to the exit surface 520 can be provided.

As shown in FIGS. 3 and 4, the incidence surface 510, which is one end of the light guide 500, may be disposed to be spaced apart from the second light source 400. The exit surface 520, which is the other end of the light guide 500, may be disposed to face the second lens 600*b*.

That is, the light of the second light source 400 incident through the incidence surface 510 may be diffused through the exit surface 520, and thus the lamp 1 may provide three-dimensional lighting, since more light is diffused through the exit surface 520, as compared to the side surfaces 530 formed as a half mirror.

In this case, the exit surface 520 may be disposed to be spaced apart from the second lens 600*b*, and a part of the exit surface 520 may be formed to protrude toward the second lens 600*b*.

As shown in FIGS. 3 and 4, for example, a center portion of the exit surface 520 has a convex shape, which is bent, to protrude toward the second lens 600*b*, but the present invention is not limited thereto, and the center portion of the exit surface 520 may be formed in various shapes, such as a concave shape, which is bent, so as to provide three-dimensional lighting.

Therefore, the convex exit surface 520 may provide three-dimensional lighting better than a flat exit surface 520.

Each of the lights emitted from the first light source 300 and the second light source 400 through the first lens 600*a* and the second lens 600*b* may exit to the outside.

In this case, any material may be applicable to the first lens 600*a* and the second lens 600*b* without limitations as long as it has light transmittance, and the material may be formed of a glass material, a polycarbonate (PC) material, a polymethylmethacrylate (PMMA) material, and other polymer resins, but is not limited thereto.

Meanwhile, as shown in FIG. 4, the diffuser 700 which improves uniformity of light may be disposed on an emission line of light between the first light source 300 and the first lens 600*a*.

Further, the diffuser 700 may be installed to be spaced apart from the first lens 600*a*.

Therefore, an air gap G may be formed between the first lens 600*a* and the diffuser 700. The air gap G may further improve uniformity of the light diffusing and exiting through the diffuser 700.

Meanwhile, the lamp 1 may further include a reflective part 800 disposed on an inner surface of the second housing part 100*b*.

The reflective part 800 may be formed of a material with high reflectance. For example, the reflective part 800 may be formed by attaching a reflective sheet to an inner surface of the second housing part 100*b* or applying a material with high reflectance to the inner surface of the second housing part 100*b*, but the present invention is not limited thereto.

The reflective part 800 may provide auxiliary light in contrast to the light guide 500.

The light guide 500 is installed to be spaced apart from the second light source 400, and the reflective part 800 reflects the light, which is not incident to the light guide 500, to be emitted to the second lens 600*b*. Therefore, the reflective part 800 may allow the light provided as a background of the light guide 500 so as to be emitted through the second lens 600*b*.

As shown in FIG. 7, when the side surfaces 530 of the light guide 500 is formed as a half mirror, the light reflected through the reflective part 800 may be emitted to the second lens 600*b* through the light guide 500.

Therefore, the lamp 1 may provide three-dimensional lighting using the light emitted to the second lens 600*b* through the light guide 500 and the light reflected from the reflective part 800, passing through the light guide 500, and emitted to the second lens 600*b*.

As shown in FIG. 8, when both an inner surface and an outer surface of the side surfaces 530 of the light guide 500 are formed as a mirror, the light reflected from the reflective part 800 may be reflected by the side surface 530 of the light guide 500 and emitted to the second lens 600*b*.

Accordingly, since the light reflected from the reflective part 800 is reflected by the side surface 530 of the light guide 500 and emitted to the second lens 600*b*, the lamp 1 may provide three-dimensional lighting unlike that in FIG. 7.

The converter 900 may be disposed on one side of the substrate 200. A DC-DC converter may be used as the converter 900. Further, the converter 900 may be controlled by a control unit (not shown).

Therefore, the converter 900 controlled by the control unit provides a controlled output voltage for the first light source 300 and the second light source 400, and thus the lamp 1 can provide various lightings.

The light emitted from the first light source 300 of the lamp 1 may be used as a light source of a tail lamp of a vehicle, and the light emitted from the second light source 400 may be used as a stop lamp of the vehicle.

The lamp 1 according to the embodiment of the present invention can provide three-dimensional lighting using the at least two light sources 300 and 400, the light guide 500, and the reflective part 800 and increase a design degree of freedom when installed in a vehicle.

While the present invention has been described with reference to exemplary embodiments, it will be understood by those skilled in the art that various changes and modifications may be made without departing from the spirit and scope of the present invention as defined by the appended claims. It will be understood that differences related to the modification and change are included in the scope of the embodiments as defined by the following claims.

DESCRIPTION OF SYMBOLS

1: LAMP
100: HOUSING
200: SUBSTRATE
300: FIRST LIGHT SOURCE
400: SECOND LIGHT SOURCE
500: LIGHT GUIDE
600*a*, 600*b*: LENS
700: DIFFUSER
800: REFLECTIVE PART
900: CONVERTER

The invention claimed is:

1. A lamp comprising:
a housing;
a substrate disposed in the housing;
a first light source and a second light source disposed on one surface of the substrate and the other surface of the substrate, respectively; and
a light guide disposed on an emission line of light of the second light source,
wherein the light guide includes:
an incidence surface to which a light of the second light source is incident;
an exit surface; and
a plurality of side surfaces disposed between the incidence surface and the exit surface.

2. The lamp of claim 1, wherein the substrate is disposed to divide the housing into a first housing part and a second housing part.

3. The lamp of claim 1, wherein the first light source and the second light source are installed on the substrate to be spaced apart from each other by a predetermined distance d.

4. The lamp of claim 1, further comprising:
a first lens disposed on an emission line of light of the first light source; and
a diffuser disposed between the first light source and the first lens.

5. The lamp of claim 4, wherein the diffuser is disposed to be spaced apart from the first lens.

6. The lamp of claim 2, wherein the light guide has one end disposed to be spaced apart from the second light source.

7. The lamp of claim 6, further comprising a second lens disposed on the emission line of light of the second light source.

8. The lamp of claim 6, wherein the light guide is disposed to be spaced apart from an inner surface of the second housing part.

9. The lamp of claim 8, wherein the second housing part includes a reflective part disposed on an inner surface thereof.

10. The lamp of claim 7, wherein one end of the light guide is bent, and the other end of the light guide is disposed to face the second lens.

11. The lamp of claim 10, wherein the light guide is formed in a polygonal pillar shape.

12. The lamp of claim 1, wherein a part or an entirety of the side surfaces is formed as a half mirror.

13. The lamp of claim 7, wherein the exit surface is formed to protrude toward the second lens.

14. The lamp of claim 1, wherein a part or an entirety of the side surfaces is formed as a mirror.

15. The lamp of claim 1, wherein the plurality of light guides disposed to be spaced apart from the plurality of second light sources are disposed to be spaced apart from each other.

16. The lamp of claim 1, wherein the first and second light sources are formed as a light emitting diode (LED).

17. A vehicle comprising the lamp of claim 1 used as a tail lamp and a stop lamp.

* * * * *